US005535692A

United States Patent [19]

Ezzy

[11] Patent Number: 5,535,692

[45] Date of Patent: Jul. 16, 1996

[54] ADJUSTABLE SAIL HEAD TENSIONING DEVICE, AND METHODS OF FABRICATING AND UTILIZING SAME

[76] Inventor: David C. Ezzy, 460 Mopua Pl., Haiku, Hi. 96708

[21] Appl. No.: 391,772

[22] Filed: Feb. 21, 1995

[51] Int. Cl.[6] ..... B63H 9/08

[52] U.S. Cl. ..... 114/103; 114/108

[58] Field of Search ..... 114/102, 103, 114/105, 108, 39.2

[56] References Cited

U.S. PATENT DOCUMENTS

| | | | |
|---|---|---|---|
| 4,198,708 | 4/1980 | Fugere et al. | 2/16 |
| 4,977,843 | 12/1990 | Ewert et al. | 114/108 |
| 5,038,699 | 8/1991 | Cochran et al. | 114/103 |

FOREIGN PATENT DOCUMENTS

| | | | |
|---|---|---|---|
| 2194499 | 3/1988 | United Kingdom | 114/103 |

*Primary Examiner*—Sherman Basinger
*Attorney, Agent, or Firm*—Weiner, Carrier & Burt; Irving M. Weiner; Joseph P. Carrier

[57] ABSTRACT

An adjustable sail head tensioning device for tensioning the head and upper leech of a windsurfing sail. The device allows the head and upper leech to twist off in strong winds; provides more power in light winds; and makes the sail easier to handle in strong winds. The head and upper leech is supported partially by an elastic member. When the sail is unloaded, the elastic tensions the upper leech by pulling the leech into the mast. When the sail is exposed to strong winds, the elastic stretches and permits the upper leech to spill off wind, which makes the sail more controllable.

20 Claims, 3 Drawing Sheets

ADJUSTABLE SAIL HEAD TENSIONING DEVICE, AND METHODS OF FABRICATING AND UTILIZING SAME

BACKGROUND OF THE INVENTION

1. Field of the Invention

The present invention relates generally to an improvement in sails, and methods of fabricating and utilizing same. In particular, the present invention relates to an adjustable sail head tensioning system preferably, but not necessarily, for a windsurfing sail.

2. Description of the Relevant Art

The term "sail" as used herein is intended primarily to mean a windsurfing sail, but the present invention may also be applicable to sails for other types of vehicles and craft which derive motive power at least partially from the wind.

Most windsurfing sails are provided with a sleeve which is pulled over the mast. In addition, most windsurfing sails are provided with a substantially loose foot. In the early years of windsurfing, the windsurfing sail was substantially triangularly-shaped.

A windsurfing sail is subjected to much greater wear than those of other sailing craft because it is often dropped into the water and also gets rough treatment on the beach or shore.

In any event, a primary concern is to make certain that the sail is controllable and manageable to sail in a great variety of wind conditions and water conditions. The area of some windsurfing sails is approximately 59 square feet. Instead of reducing the area in strong winds by reefing, in the past sometimes a smaller sail was used, such as a 48 square foot all-weather, or all-round, sail which is cut specifically for use when the wind strength increases.

Sometimes a storm sail of approximately 37 square feet is designed for really hard winds, but can also be used by children or by learners when the wind is moderate. There have also been extra-large sails of approximately 70 square feet or greater for use when racing and in light weather, but sail size is invariably limited by the length of the mast and the length of the wishbone boom.

Those sails which are cut with a rounded convex leech have battens to support the trailing edge. The battens are intended to ensure that the sail remains "stiff" and maintains the "best" profile.

The amount of twist in a sail is also a very important consideration. The twist in the sail may be observed by looking from behind the sail when it is sheeted in to see how straight the leech is. If there is a great deal of twist in the sail, the top third of the leech will fall away. On the other hand, if the leech is too tight, it will hook the top part of the sail to windward. To better understand the amount of twist in a sail, one must consider wind speed.

Although the wind speed arising from the windsurfer board speed is substantially the same at all heights from the board to the top of the mast, the true wind speed increases with height above the surface of the board. The wind approximately four yards above the board blows about 25% faster than the wind one yard over the board. For example, a wind which is blowing at about 16 knots at a height of one yard above the board will blow at about 29 knots at the head of the sail. Consequently, when the board is sailing at 10 knots on a beam reach the apparent wind gradually frees to blow from a direction of about 5° nearer the stern at the head of the sail. When the board is sailing at the same speed in such a wind on a close-hauled course the difference in the angle of attack is only about 2°, but when broad reaching is about 12°.

Heretofore, sail camber was varied from the sail foot to the sail head to match the gradual freeing of the wind with height above the board. When a sail which is full of wind is viewed from astern, it is evident that the upper third of the leech must be open in a wind of this strength.

When the sail or the leech is said to be "open", it means that the horizontal profile of the sail is flat near the leech which, owing to wind pressure, lies to leeward of the direct line between the sail head and the sail clew. If the leech or the sail is said to be "closed", the curvature of the sail is continued right to the leech which stands up to windward of this direct line. The art of sail trimming is to adjust the tension of the leech so that the amount that it opens matches the wind at the moment. When close-hauled, the leech should not be closed by wind pressure. Rather, it must lie to leeward of the line from the head to the clew.

Previous techniques for attempting to adjust the tension of the leech involved varying the mast curvature, the foot tension, and the height at which the wishbone boom is attached to the mast. Other attempts involved the use of a kicking strap which could therefore be called a leech tensioner.

Raising the front of the wishbone boom makes the outhaul pull downwardly more, which in turn tightens the leech of the sail, thereby reducing the amount of twist. However, most sails do not allow much adjustment of the wishbone boom height. Furthermore, it is uncomfortable to sail with a boom which is too high or too low.

Another way of attempting to control the leech tension is to use a kicking strap or boom vang, that is, a line from the foot of the mast to the end of the boom. This can be very effective, but it does have disadvantages. One disadvantage is that the boom vang tends to catch on the top of the daggerboard when tacking. Also, as the mast bends, the vang slackens off and loses its effect. Thus, the kicking strap or boom vang is not very beneficial with a bending mast or in gusty winds. Overall, the use of a kicker or boom vang is not recommended.

None of the previous devices and techniques have provided a construction, assembly or system which easily controls the tension on the sail head and the upper leech of the sail. Indeed, a desideratum of the present invention is to avoid the animadversions of the previous devices and techniques. It would thus be desirable to provide a construction and system which, in addition to eliminating the aforementioned problems and disadvantages of the previous techniques, provides very new and desirable features heretofore unattainable.

SUMMARY OF THE INVENTION

The present invention provides an adjustable sail head tensioning device, comprising, in combination, a sail including a sail body portion, a sail head portion, and at least one predetermined sail edge portion. There are also provided first means for releasably interconnecting said sail to at least one mast. Said first means includes substantially elastic means connected to at least portion of said predetermined sail edge portion, such as the upper leech of the sail. Said substantially elastic means supports at least partially said sail head portion and said predetermined sail edge portion. When said sail is exposed to a substantially light wind condition, said substantially elastic means urges said predetermined sail edge portion toward said mast. On the other hand, when said sail is exposed to a substantially strong wind condition, said substantially elastic means stretches and permits said predetermined sail edge portion to spill off air.

The present invention also provides an adjustable sail head tensioning device comprising a sail including first means for mounting the sail to a mast. The tensioning device also includes substantially elastic means for at least partially supporting the sail at its head and upper leech. The substantially elastic means is upwardly disposed inside the first means.

The present invention also provides an adjustable sail head tensioning device comprising a sail including first means for mounting the sail to a mast. The first means is provided with at least one portion thereof formed of substantially stretchy fabric. The substantially stretchy fabric portion has disposed therein a substantially elastic component.

It is an object of the present invention to provide an adjustable sail head tensioning system for controlling the tension of the sail head and the upper leech of the sail.

It is a further object of the present invention to provide an adjustable sail head tensioning system which allows the head and the upper leech of a sail to twist off in strong winds.

Yet another object of the present invention is to provide an adjustable sail head tensioning system which achieves more power in light wind sailing.

It is still a further object of the present invention to provide an adjustable sail head tensioning system which makes a sail easier to handle in strong winds. It also provides a sail tensioning device comprising a sail including a body portion and first means for mounting the sail to a mast. There may optionally be provided an elastic portion disposed between the body portion and the first means.

The present invention provides a novel sail tensioning construction wherein the head and upper leech of the sail is supported at least partially by an elastic component. When the sail is unloaded (light wind), the elastic component tensions the upper leech by pulling the leech into or toward the mast. When sailing in strong winds, the elastic component stretches and allows the upper leech to spill off wind, which makes the sail more controllable and easier to sail.

Other objects, advantages, and applications of the present invention will become apparent to those skilled in the art of sail and sail tensioning construction when the accompanying description of some examples of the best modes contemplated for practicing the invention is read in conjunction with the accompanying drawings.

BRIEF DESCRIPTION OF THE DRAWINGS

The description herein makes reference to the accompanying drawings wherein like reference numerals refer to like or equivalent parts and in which.

DESCRIPTION OF SOME PREFERRED EMBODIMENTS

Figure 1:
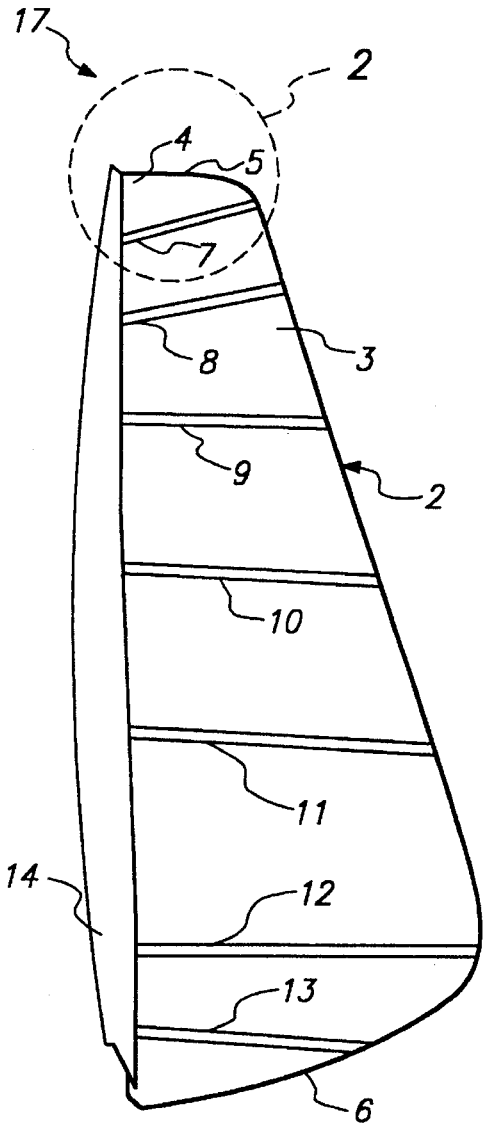
FIG. 1 illustrates an overall sail and head tensioning device in accordance with a first embodiment of the present invention.

Referring to FIG. 1, there is depicted a first embodiment of the present invention comprising an adjustable sail head tensioning device generally denoted by the reference numeral 1.

As illustrated in FIG. 1, there is shown a sail 2 including a sail body portion 3, the sail head portion 4, and at least one predetermined sail edge portion, such as, for example, the upper leech 5. FIG. 1 also shows the foot 6 of the sail, as well as a plurality of batten pockets 7, 8, 9, 10, 11, 12 and 13.

First means, including a mast sleeve 14, releasably interconnects the sail 2 to a mast 15. In accordance with one embodiment of the present invention, the first means may include substantially elastic means, such as an elastic member 16, connected to at least a portion 17 of the predetermined sail edge portion, such as the upper leech 5.

As best illustrated in FIGS. 2, 3, 4 and 5, the elastic member 16 supports at least partially the sail head portion 4 and the upper leech 5.

Figure 2:
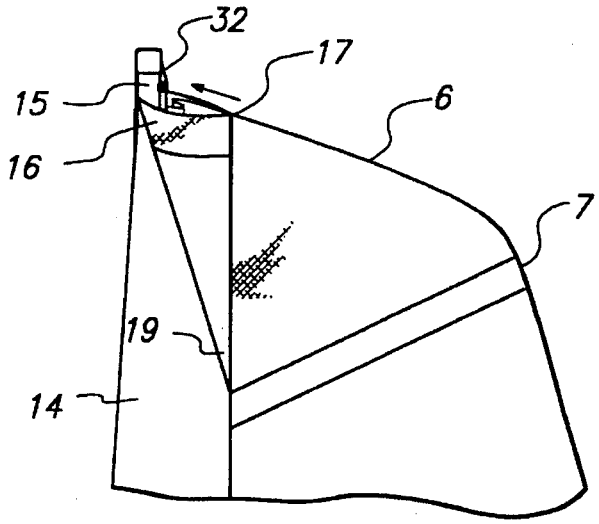
FIG. 2 illustrates on an enlarged scale the portion of FIG. 1 circled in phantom line, and depicted, partially in section, under a condition of substantially light wind.
Figure 3:
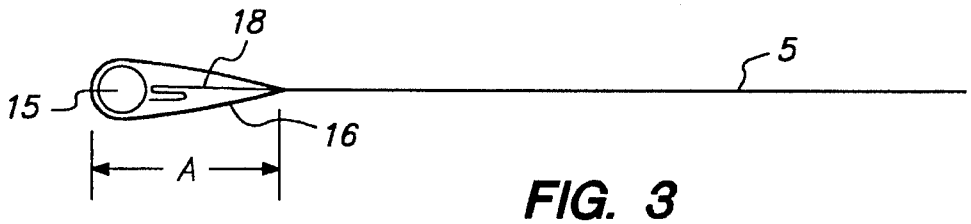
FIG. 3 is a top schematic view of the embodiment of the present invention as illustrated in FIG. 2 under a condition of substantially light wind.

With reference to FIGS. 2 and 3, when the sail 2 is exposed to a substantially light wind condition, the elastic member 16 urges the upper leech 5 toward the mast 15. In other words, in such a light wind condition, the elastic 16 tightens the edge 5 of the sail. When the sail 2 is unloaded (light wind), the elastic 16 tensions the upper leech 5 by pulling the leech 5 into the mast 15.

Figure 5:
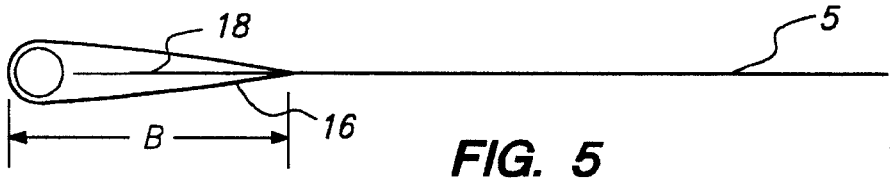
FIG. 5 illustrates a top schematic view of FIG. 4.
Figure 4:
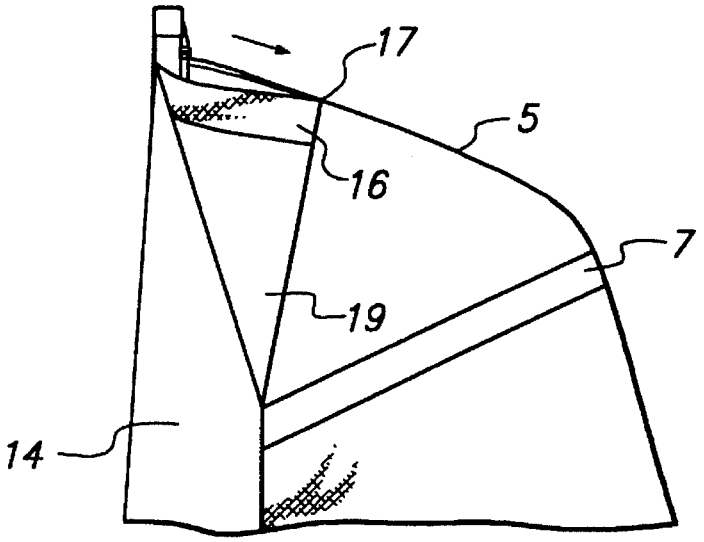
FIG. 4 illustrates the embodiment of the invention as depicted in FIG. 2, but in FIG. 4 it is shown under a condition of substantially strong wind.

With reference to FIGS. 4 and 5, when the sail 2 is exposed to a substantially strong wind condition, the substantially elastic means 16 stretches and permits the upper leech 5 to spill off wind, which makes the sail 2 more controllable and easier to sail.

With reference to FIGS. 2, 3, 4 and 5, it should be noted that the elastic 16 forms part of the mast sleeve 14, is affixed to the upper leech 5 and a part of the sail head portion 4, and passes around the mast 15. At least a part 18 of the sail head portion 4 is disposed within and displacable within the elastic 16.

As shown in FIG. 2 and FIG. 3, in a light wind condition, a portion of the sail head portion 4 is folded within the elastic 16, which tightens the edge 5 of the sail so that there is an approximate dimension A between the point of attachment of the elastic 16 to the sail edge 5 and that portion of the mast sleeve 14 which is remote from the sail 2.

In contradistinction, FIG. 4 and FIG. 5 show the same embodiment under a strong wind condition, wherein the elastic 16 stretches and loosens the edge 5 of the sail, and stretches to a dimension B. It should be noted that the dimension B is substantially greater than the dimension A. It should also be noted with reference to FIG. 4 and FIG. 5 that the portion 18 of the sail head portion 4 which is disposed within the elastic 16 is no longer folded upon itself as the elastic 16 stretches and loosens the edge 5 of the sail.

Optionally, but not necessarily, the elastic 16 may be covered by a substantially stretchy fabric 19, such as, for example, Lycra.

It should also be noted that preferably, but not necessarily, the portion of the mast sleeve 14 which includes the elastic 16 and the substantially stretchy fabric 19 extends from the top of the sail 2 to the uppermost batten pocket 7.

Figure 6:
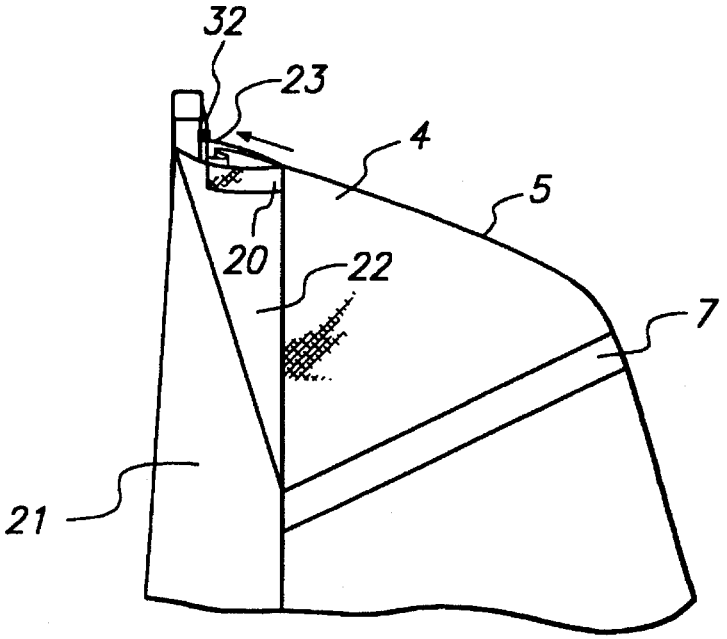
FIG. 6 illustrates an alternate embodiment of the present invention, shown partially in section, and under a condition of substantially light wind.
Figure 7:
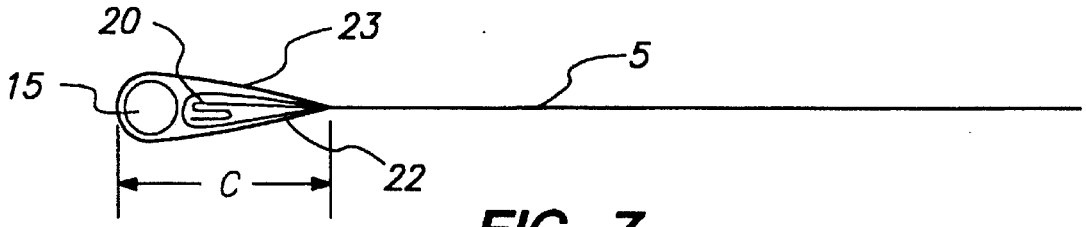
FIG. 7 is a top schematic view of FIG. 6.
Figure 8:
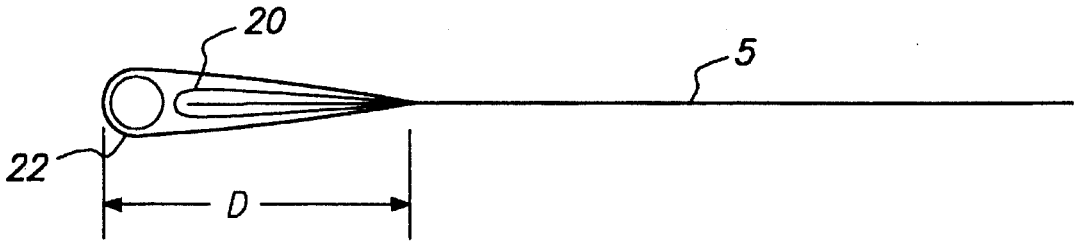
FIG. 8 illustrates a top schematic view similar to FIG. 7, but shown under a condition of substantially strong wind.

FIG. 6, 7 and 8 illustrate a modified embodiment of the present invention. FIGS. 6 and 7 depict this modified embodiment under a substantially light wind condition, whereas FIG. 8 illustrates the same modified embodiment under a substantially strong wind condition.

In the modified embodiment of the present invention as illustrated in FIGS. 6, 7 and 8, a portion of the sail head portion 4 is disposed within and displacable within the substantially elastic means 20. In this modified embodiment the first means includes a mast sleeve 21, a predetermined portion of which is constructed from substantially stretchy fabric 22. The substantially stretchy fabric portion 22 is disposed around the mast 15. The elastic portion 20 is not disposed around the mast 15.

When the sail 2 is exposed to a substantially light wind condition, the elastic means 20 urges the upper leech 5 toward the mast 15 as shown in FIGS. 6 and 7. Note the dimension C between the point of attachment of the elastic 20 to the upper leech 5 and the point of the mast sleeve 21 which is remote from the sail body portion 3. In such light wind condition, it should be noted in FIG. 7 that there is a folded-over portion 23 of the sail head portion 4 enclosed within the elastic 20.

In contrast, in a substantially strong wind condition, as depicted in FIG. 8, the similar sail portion 23 is no longer folded-over, and the dimension D is much larger than the dimension C.

Thus, the main difference between the first embodiment described hereinabove and the modified embodiment, is that in the modified embodiment of FIGS. 6, 7 and 8 the elastic 20 does not go around the mast 15, but instead merely goes around the front portion 23 of the sail, and the elastic 20 is sewn only at the end where it meets the mast sleeve.

Figure 9:
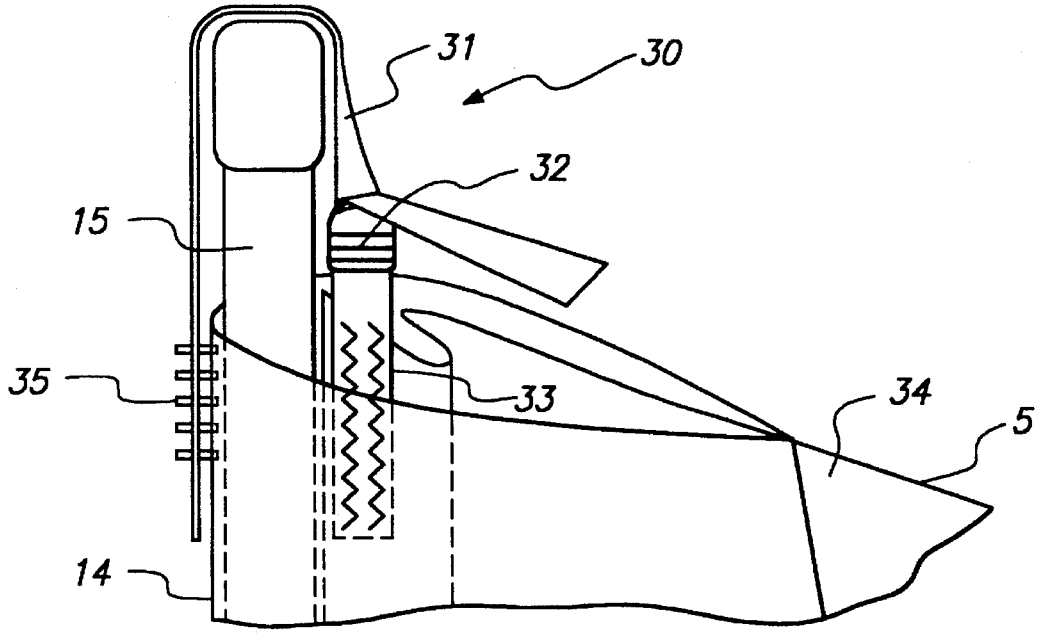
FIG. 9 illustrates a head/buckle/webbing assembly which may optionally be employed in connection with various embodiments of the present invention.

FIG. 9 illustrates a head/buckle/webbing assembly 30 which preferably, but not necessarily, may be used in conjunction with some, if not all, embodiments of the present invention. FIG. 9 illustrates how a webbing 31 and buckle 32 attach to the sail 2. The webbing 31 may be sewn to the front of the mast sleeve 14 by stitching 35 (represented on an enlarged scale in FIG. 9 or clarity) to the front of the mast sleeve 14. The webbing 31 is disposed over the mast 15, and then locks in a ladderlock buckle 32 which is sewn or otherwise affixed to a predetermined portion 33 of the sail head portion 34.

It should be noted that although the aforementioned drawings illustrate an elastic portion 16 or 20 and a substantially stretchy fabric portion 19 or 22, for ease in explaining the constructional detail of the invention, these portions are not observable from outside of the sail. Rather, the viewer of the sail 2 sees a complete sail and mast sleeve 14 or 21 without viewing the inner elastic and stretchy fabric portions.

It should also be noted that the fold or pucker of the sail material as shown in the drawings is that portion of the sail material which is being displaced inside the mast sleeve 14 or 21. In other words, any looseness is always contained inside the wide mast sleeve area. It will be appreciated by those skilled in the area of sail fabrication that the mast sleeve of the present invention is wider than conventional mast sleeves.

From the foregoing, it will be appreciated that the novel adjustable sail head tensioning device according to the present invention achieves the novel tensioning of the head and upper leech of sails, and in particular of windsurfing sails. The present invention allows the head and upper leech 5 to twist off in strong winds; provides more power in light wind sailing; and makes the sail 2 easier to handle in strong winds.

In particular, the head and upper leech 5 is supported at least partially by an elastic member. When the sail is unloaded (light wind) the elastic tensions the upper leech 5 by pulling the upper leech 5 into the mast 15. When sailing in strong winds, the elastic stretches and allows the upper leech 5 to spill off wind, which makes the sail 2 more controllable and easier to sail.

It is also significant to note that the recent trend in windsurfing has been focused on racing sails. Such racing sails have very floppy leech sails, and they do not have very good low end because the leeches are so loose. However, with the present invention, the leech is tightened up to achieve an added advantage of better and more low end light wind sailing, and when sailing powered up the sail tensioning device also achieves the desired sail twist. From the foregoing it will be appreciated that the present invention provides a simple, practical, and reliable adjustable sail head tensioning construction which is attractive in appearance, economical to manufacture, and is durable and efficient during its useful life.

While the foregoing has described the features and advantages of several embodiments of the present invention, it will be apparent to those skilled in the art of sail fabrication and sail head tensioning devices that changes in form and proportion and minor details of construction may be resorted to without departing from the spirit of the present invention or the scope of the appended claims.

I claim:

1. An adjustable sail head tensioning device, comprising, in combination:

a sail including a sail body portion, a sail head portion, and at least one predetermined sail edge portion;

first means for releasably interconnecting said sail to at least one mast;

said first means including substantially elastic means connected to at least a portion of said predetermined sail edge portion;

said substantially elastic means supporting at least partially said sail head portion and said predetermined sail edge portion;

said substantially elastic means urging said predetermined sail edge portion toward said mast when said sail is exposed to a substantially light wind condition;

and said substantially elastic means stretching so as to permit said predetermined sail edge portion to spill off air when said sail is exposed to a substantially strong wind condition.

2. An adjustable sail head tensioning device according to claim 1, wherein:

said first means for releasably interconnecting said sail to at least one mast includes a mast sleeve; and said substantially elastic means is disposed around said mast and forms part of said mast sleeve.

3. An adjustable sail head tensioning device according to claim 2, wherein:

said substantially elastic means is covered by a substantially stretchy fabric.

4. An adjustable sail head tensioning device according to claim 3, including:

second means for releasably interconnecting at least a portion of said sail head portion which is proximal to said mast with at least a portion of said first means which is remote from said sail body portion.

5. An adjustable sail head tensioning device according to claim 2, including:

second means for releasably interconnecting at least a portion of said sail head portion which is proximal to said mast with at least a portion of said first means which is remote from said sail body portion.

6. An adjustable sail head tensioning device according to claim 1, wherein:

said substantially elastic means is covered by a substantially stretchy fabric.

7. An adjustable sail head tensioning device according to claim 6, including:

second means for releasably interconnecting at least a portion of said sail head portion which is proximal to said mast with at least a portion of said first means which is remote from said sail body portion.

8. An adjustable sail head tensioning device according to claim 1, including:

second means for releasably interconnecting at least a portion of said sail head portion which is proximal to said mast with at least a portion of said first means which is remote from said sail body portion.

9. An adjustable sail head tensioning device, comprising, in combination:

a sail including a sail body portion, a sail head portion and at least one predetermined sail edge portion;

first means for releasably interconnecting said sail to at least one mast;

said first means including substantially elastic means connected to a portion of said predetermined sail edge portion:

said substantially elastic means supporting at least partially said sail head portion and said predetermined sail edge portion: and at least a portion of said sail head portion is displacable within said first means for releasably interconnecting said sail to at least one mast;

whereby when said sail is exposed to a substantially light wind condition, said substantially elastic means urges said predetermined sail edge portion toward said mast: and whereby when said sail is exposed to a substantially strong wind condition, said substantially elastic means stretches and permits said predetermined sail edge portion to spill off air.

10. An adjustable sail head tensioning device according to claim 9, wherein:

said substantially elastic means is covered by a substantially stretchy fabric.

11. An adjustable sail head tensioning device according to claim 10, including:

second means for releasably interconnecting at least a portion of said sail head portion which is proximal to said mast with at least a portion of said first means which is remote from said sail body portion.

12. An adjustable sail head tensioning device according to claim 9, including:

second means for releasably interconnecting at least a portion of said sail head portion which is proximal to said mast with at least a portion of said first means which is remote from said sail body portion.

13. An adjustable sail head tensioning device, comprising, in combination;

a sail including a sail body portion, a sail head portion, and at least one predetermined sail edge portion:

first means for releasably interconnecting said sail to at least one mast;

said first means including substantially elastic means connected to at least a portion of said predetermined sail edge portion;

said substantially elastic means supporting at least partially said sail head portion and said predetermined sail edge portion;

said first means for releasably interconnecting said sail to at least one mast includes a mast sleeve:

said substantially elastic means is disposed around said mast and forms part of said mast sleeve: and at least a portion of said sail head portion is displacable within said first means for releasably interconnecting said sail to at least one mast;

whereby when said sail is exposed to a substantially light wind condition, said substantially elastic means urges said predetermined sail edge portion toward said mast; and whereby when said sail is exposed to a substantially strong wind condition, said substantially elastic means stretches and permits said predetermined sail edge portion to spill off air.

14. An adjustable sail head tensioning device according to claim 13, wherein:

said substantially elastic means is covered by a substantially stretchy fabric.

15. An adjustable sail head tensioning device according to claim 14, including:

second means for releasably interconnecting at least a portion of said sail head portion which is proximal to said mast with at least a portion of said first means which is remote from said sail body portion.

16. An adjustable sail head tensioning device according to claim 13, including:

second means for releasably interconnecting at least a portion of said sail head portion which is proximal to said mast with at least a portion of said first means which is remote from said sail body portion.

17. An adjustable sail head tensioning device comprising, in combination;

a sail including a sail body portion, a sail head portion, and at least one predetermined sail edge portion;

first means for releasably interconnecting said sail to at least one mast;

said first means including substantially elastic means connected to at least a portion of said predetermined sail edge portion;

said substantially elastic means supporting at least partially said sail head portion and said predetermined sail edge portion;

at least a portion of said sail head portion is disposed within said substantially elastic means and is displaceable within said substantially elastic means;

said first means includes a mast sleeve at least a portion of which is constructed of substantially stretchy fabric; and said substantially elastic means is disposed within said substantially stretchy fabric portion of said mast sleeve; and whereby when said sail is exposed to a substantially light wind condition, said substantially elastic means urges said predetermined sail edge portion toward said mast; and whereby when said sail is exposed to a substantially strong wind condition, said substantially elastic means stretches and permits said predetermined sail edge portion to spill off air.

18. An adjustable sail head tensioning device according to claim 17, including:

second means for releasably interconnecting at least a portion of said sail head portion which is proximal to said mast with at least a portion of said first means which is remote from said sail body portion.

19. An adjustable sail head tensioning device, comprising, in combination:

a windsurfing sail including a sail body portion, a sail head portion, and an upper leech;

a mast sleeve for releasably interconnecting said windsurfing sail to a mast;

said mast sleeve including a substantially elastic portion which is connected to at least a portion of said upper leech;

said substantially elastic portion supporting at least partially said sail head portion and said upper leech;

at least a portion of said sail head portion is disposed within and displacable within said substantially elastic portion of said mast sleeve;

whereby when said sail is exposed to a substantially light wind condition, said substantially elastic portion urges said upper leech toward said mast; and whereby when said sail is exposed to a substantially strong wind condition, said substantially elastic portion stretches and permits said upper leech to spill off air.

20. An adjustable sail head tensioning device, comprising, in combination:

a windsurfing sail including a sail body portion, a sail head portion, and an upper leech;

a mast sleeve for releasably interconnecting said windsurfing sail to a mast;

said mast sleeve including a predetermined substantially stretchy fabric portion;

substantially elastic means connected to said upper leech;

at least a portion of said sail head portion being disposed within and displacable within said substantially elastic means;

said substantially elastic means being disposed within said predetermined substantially stretchy fabric portion of said mast sleeve;

said predetermined substantially stretchy fabric portion of said mast sleeve and said substantially elastic means supporting at least partially said sail head portion and said upper leech;

whereby when said sail is exposed to a substantially light wind condition, said predetermined substantially stretchy fabric portion of said mast sleeve and said substantially elastic means urge said upper leech toward said mast; and whereby when said sail is exposed to a substantially strong wind condition, said predetermined substantially stretchy fabric portion of said mast sleeve and said substantially elastic means stretch and permit said upper leech to spill off air.

* * * * *